US006698036B2

(12) United States Patent
Armbruster et al.

(10) Patent No.: US 6,698,036 B2
(45) Date of Patent: Mar. 2, 2004

(54) POTTY TRAINING DEVICE

(75) Inventors: Michael Dean Armbruster, Buffalo, NY (US); Karen Fitzgerald, Elma, NY (US); Domenic Thomas Gubitosi, Aurora, NY (US); John Martin Maul, Machias, NY (US)

(73) Assignee: Mattel, Inc., El Segundo, CA (US)

( * ) Notice: Subject to any disclaimer, the term of this patent is extended or adjusted under 35 U.S.C. 154(b) by 80 days.

(21) Appl. No.: 09/970,030

(22) Filed: Oct. 4, 2001

(65) Prior Publication Data

US 2003/0066126 A1 Apr. 10, 2003

(51) Int. Cl.[7] ..... A47K 11/06
(52) U.S. Cl. ..... 4/483; 4/902; 4/661
(58) Field of Search ..... 4/483, 235, 234, 4/239, 237, 449, 254, 661, 902

(56) References Cited

U.S. PATENT DOCUMENTS

| | | | | |
|---|---|---|---|---|
| 1,172,566 A | | 2/1916 | Sawyer | |
| 1,281,763 A | | 10/1918 | Carré | |
| D147,828 S | | 11/1947 | Beckwith | |
| D148,247 S | | 12/1947 | Kirkpatrick | |
| 2,682,914 A | * | 7/1954 | Wing | 297/51 |

(List continued on next page.)

FOREIGN PATENT DOCUMENTS

| | | | |
|---|---|---|---|
| CH | 311143 | | 1/1956 |
| DE | 2947815 A1 | * | 9/1981 |
| FR | 2617-035 A1 | | 12/1988 |
| WO | WO 00/01290 | * | 1/2000 |

OTHER PUBLICATIONS

Fisher–Price product ad for the Oh–So–Simple Potty from p. 146 of the Fisher–Price Toy Fair 1999 Product Catalog.

Fisher–Price product ads for the Step Stool Potty and the 1–2–3 Potty from pp. 18–19 of the Fisher–Price 1996 Children's Product Catalog.

*Primary Examiner*—Gregory Huson
*Assistant Examiner*—Huyen Le
(74) *Attorney, Agent, or Firm*—Cooley Godward LLP

(57) ABSTRACT

A potty training device having a seat with an opening for receiving bodily waste, a sensor for sensing bodily waste, and a sensory output generator. The seat includes a retaining member configured and located so as to retain the seat in place with respect to a toilet such that the opening of the seat is located above a bowl of the toilet. The sensor senses the bodily waste that passes through the opening of the seat, and the sensory output generator generates a sensory output in response to the sensor sensing the bodily waste. A potty training device having a seat with an opening for receiving bodily waste and an electronic unit that includes a housing that at least partially contains a sensor for sensing the bodily waste, a power source, and a sensory output generator for outputting a sensory output when the sensor senses the bodily waste. The electronic unit and/or the seat includes a mechanism located and configured to removably couple the electronic unit and the seat such that the sensor is located so as to sense bodily waste received by the opening of the seat.

56 Claims, 17 Drawing Sheets

U.S. PATENT DOCUMENTS

| | | | | | |
|---|---|---|---|---|---|
| 2,788,764 | A | | 4/1957 | Headlee | |
| D201,427 | S | | 6/1965 | Roe | |
| 3,235,884 | A | | 2/1966 | Rehsteiner | |
| 3,343,179 | A | * | 9/1967 | Sellars, Jr. et al. | 4/476 |
| 3,416,163 | A | | 12/1968 | Jordan | |
| 3,691,980 | A | | 9/1972 | Shastal | |
| D243,088 | S | | 1/1977 | Halvorsen | |
| 4,162,490 | A | | 7/1979 | Fu et al. | |
| 4,491,991 | A | | 1/1985 | Herbruck | |
| 4,509,215 | A | | 4/1985 | Paz | |
| 4,777,672 | A | | 10/1988 | Gebhard et al. | |
| 4,777,680 | A | | 10/1988 | Paz | |
| 4,883,749 | A | | 11/1989 | Roberts et al. | |
| 5,008,964 | A | | 4/1991 | Dean et al. | |
| D336,789 | S | | 6/1993 | Yang | |
| D341,650 | S | | 11/1993 | Burden | |
| 5,518,405 | A | | 5/1996 | Aiello | |
| 5,535,456 | A | | 7/1996 | Chai | |
| D377,971 | S | | 2/1997 | Vanakkeren et al. | |
| 5,664,867 | A | | 9/1997 | Martin et al. | |
| 5,668,333 | A | | 9/1997 | Horton et al. | |
| 5,685,029 | A | | 11/1997 | Gee | |
| 5,748,096 | A | | 5/1998 | Kaufer | |
| 5,781,939 | A | | 7/1998 | Bledsoe | |
| 5,852,832 | A | | 12/1998 | Voigt et al. | |
| 5,870,015 | A | | 2/1999 | Hinkel | |
| 5,893,178 | A | | 4/1999 | Wosiek | |
| 5,974,598 | A | | 11/1999 | Granda-Cabrera | |
| 5,978,976 | A | | 11/1999 | Chai | |
| 6,028,520 | A | | 2/2000 | Maehre | |
| 6,037,871 | A | | 3/2000 | Babylon | |
| 6,052,838 | A | * | 4/2000 | Thom et al. | 4/239 |
| 6,142,849 | A | | 11/2000 | Horton et al. | |

* cited by examiner

POTTY TRAINING DEVICE

TECHNICAL FIELD

This invention relates generally to potty training devices, and more particularly, to potty training devices that generate a sensory output when a sensor senses bodily waste.

BACKGROUND OF THE INVENTION

Parents often experience difficulties when attempting to potty train their children. Thus, potty training devices have been developed.

One conventional potty training device is constructed such that it can be positioned upon a conventional toilet. This potty training device, however, does not detect the passing of bodily waste and does not reward the user for passing bodily waste. Hence, it is difficult for parents to potty train their children with this conventional potty training device.

Another conventional potty training device is defined by a complicated chair-like structure having detectors that detect bodily waste received by the potty training device. When the detectors detect bodily waste received by the potty training device, the potty training device generates effects to reward the user of the potty training device. Because these detectors are often in contact with the bodily waste, it is desirable to clean the detectors. One problem associated with this conventional potty training device is that it is assembled as a unitary structure with the detectors and other electronics therein. Hence, the detectors and other portions of this potty training device are not readily removable from the device for cleaning. Additionally, this chair-like potty training device is configured such that it cannot be used with a conventional toilet.

Still another conventional potty training device includes a receptacle having a mechanical box located therein that produces music to reward the user of the potty training device when bodily waste lands in the receptacle and trips a mechanical switch. Because the music box is located within the receptacle, users are required to place a bag in the receptacle each time the potty training device is used. Otherwise, the bodily waste dirties the music box and the receptacle, making it difficult to clean. Additionally, this conventional potty training device is configured such that it cannot be used in combination with a conventional toilet.

SUMMARY OF THE INVENTION

Generally speaking, embodiments of the present invention strive to provide a potty training device having a sensor that senses bodily waste and that can be easily removed for cleaning.

Embodiments of the present invention also strive to provide a potty training device that rewards a user for passing bodily waste and that can be used in combination with a conventional toilet.

Other advantages associated with the present invention will become more readily apparent to those skilled in the art from the following detailed description. As will be realized, the invention is capable of other and different embodiments, and its several details are capable of modification in various obvious aspects, all without departing from the invention. Accordingly, the drawings and the description are to be regarded as illustrative in nature, and not limitative.

DETAILED DESCRIPTION OF THE PREFERRED EMBODIMENT

Figure 1:
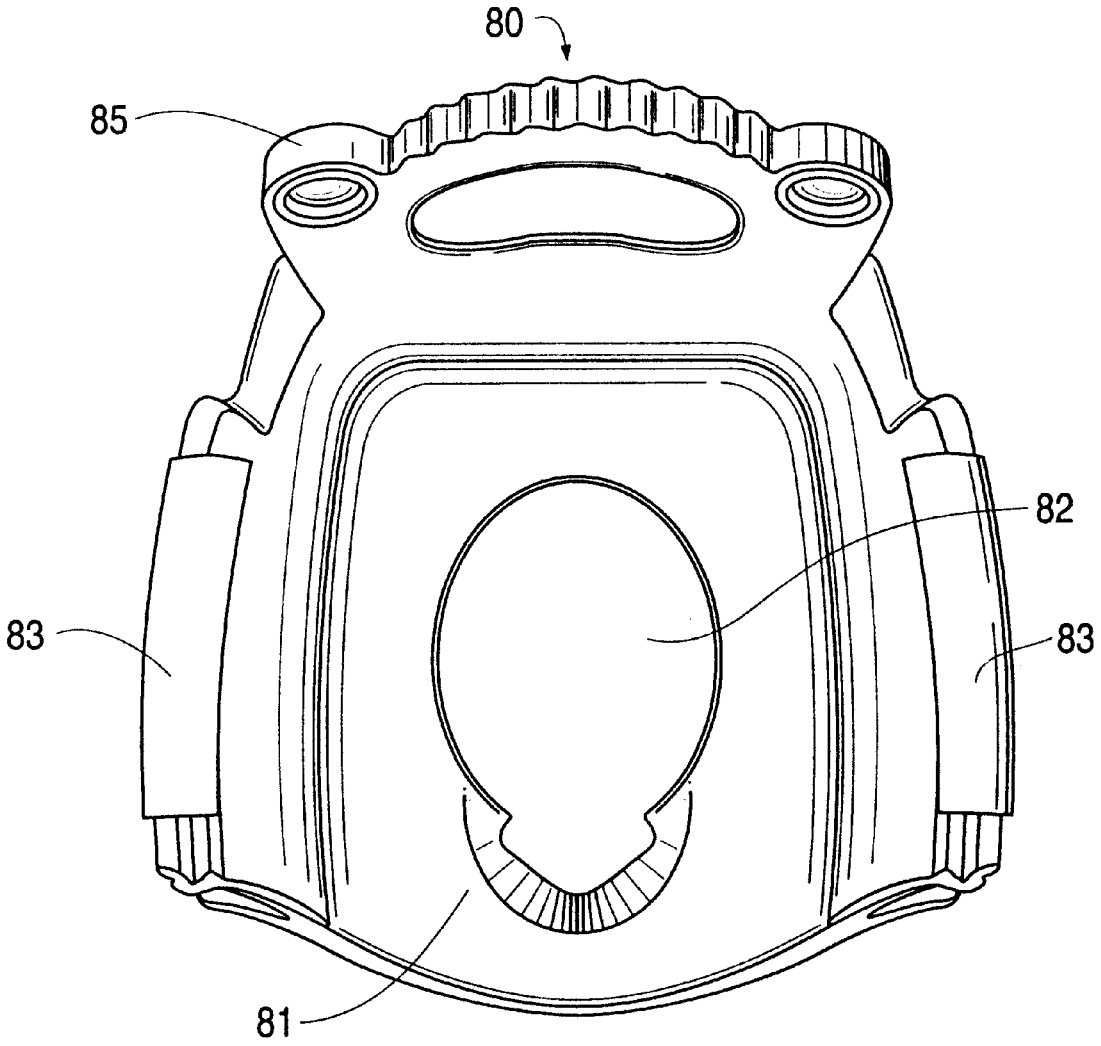
FIG. 1 is a top view of a potty training device including a seat in accordance with the present invention.
Figure 2:
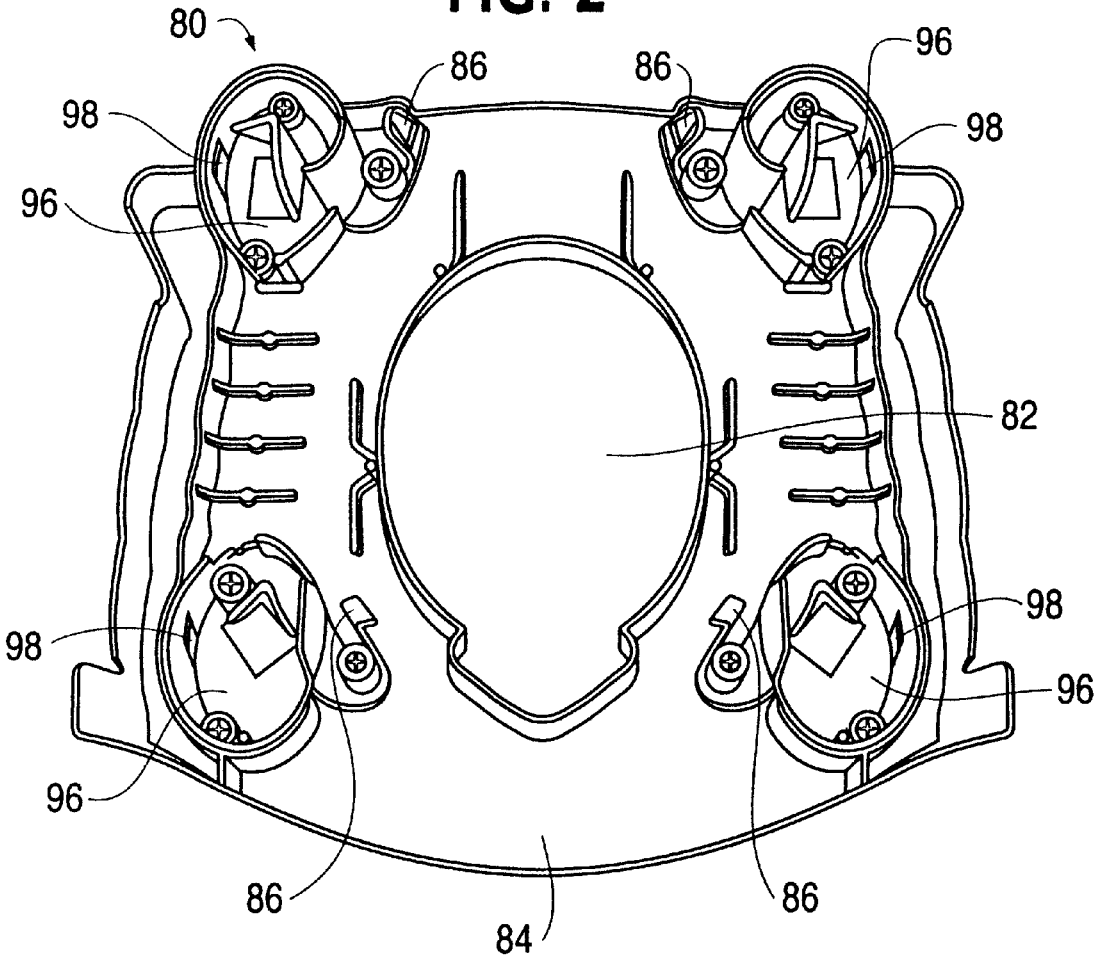
FIG. 2 is a bottom view of the seat illustrated in FIG. 1.

One embodiment of a potty training device 30 in accordance with the present invention is illustrated in FIGS. 1–15. As described below in further detail, the potty training device 30 includes a sensor 62 the senses bodily waste that passes through an opening 82 of a seat 80 and a sensory output generator 66 that generates a sensory output in response to the sensor sensing the bodily waste. Hence, the user of the potty training device 30 is rewarded for passing bodily waste when using the potty training device 30.

As is illustrated in FIG. 1, the seat 80 of the potty training device 30 is configured to support a seated user on a top surface 81 and includes the opening 82 passing therethrough for receiving bodily waste from the user, such as urine and feces. In the illustrated embodiment, the seat 80 includes two arms 83 and a back 85. However, in an alternative embodiment, the seat 80 does not include the arms 83 and back 85.

Figure 4:
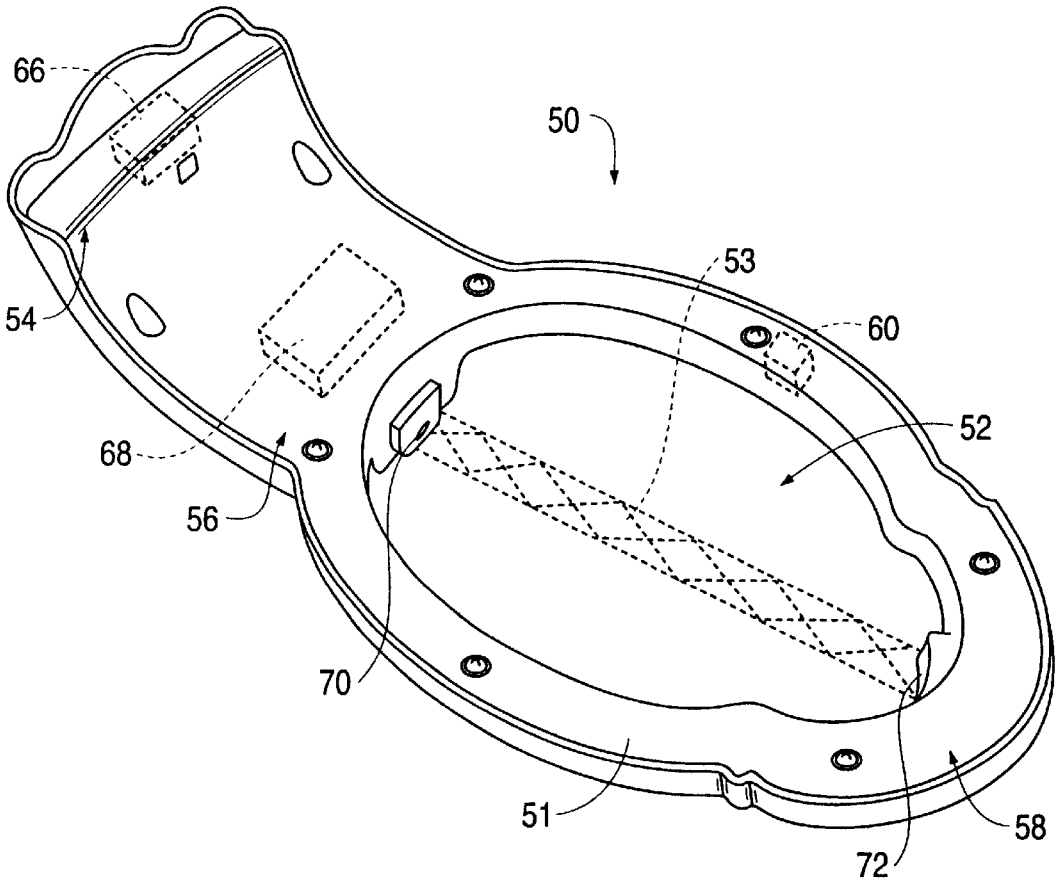
FIG. 4 is a perspective view of an electronic unit of the potty training device illustrated in FIG. 1.
Figure 5:
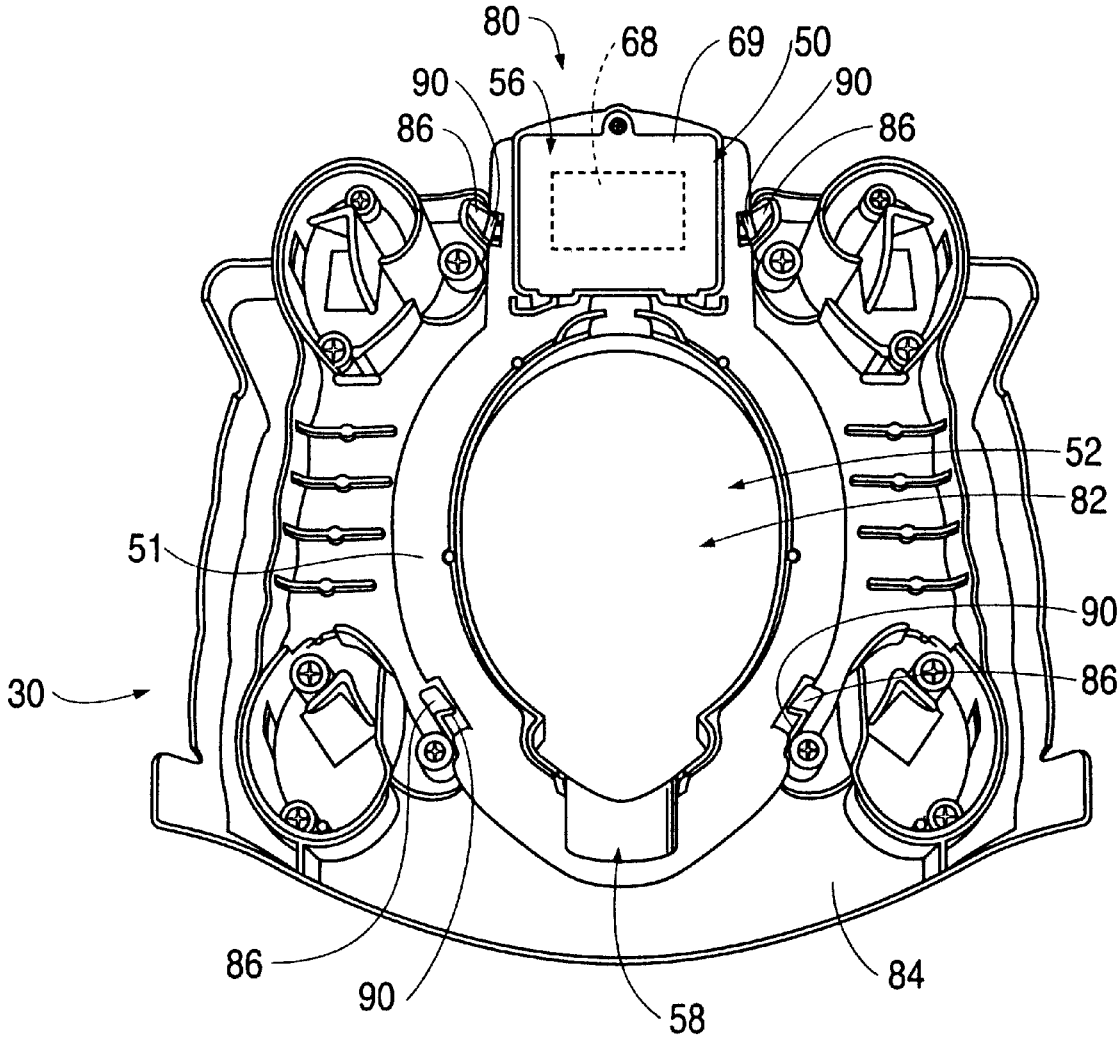
FIG. 5 is a bottom view of the seat illustrated in FIG. 1 with the electronic unit illustrated in FIG. 4 coupled thereto.
Figure 6:
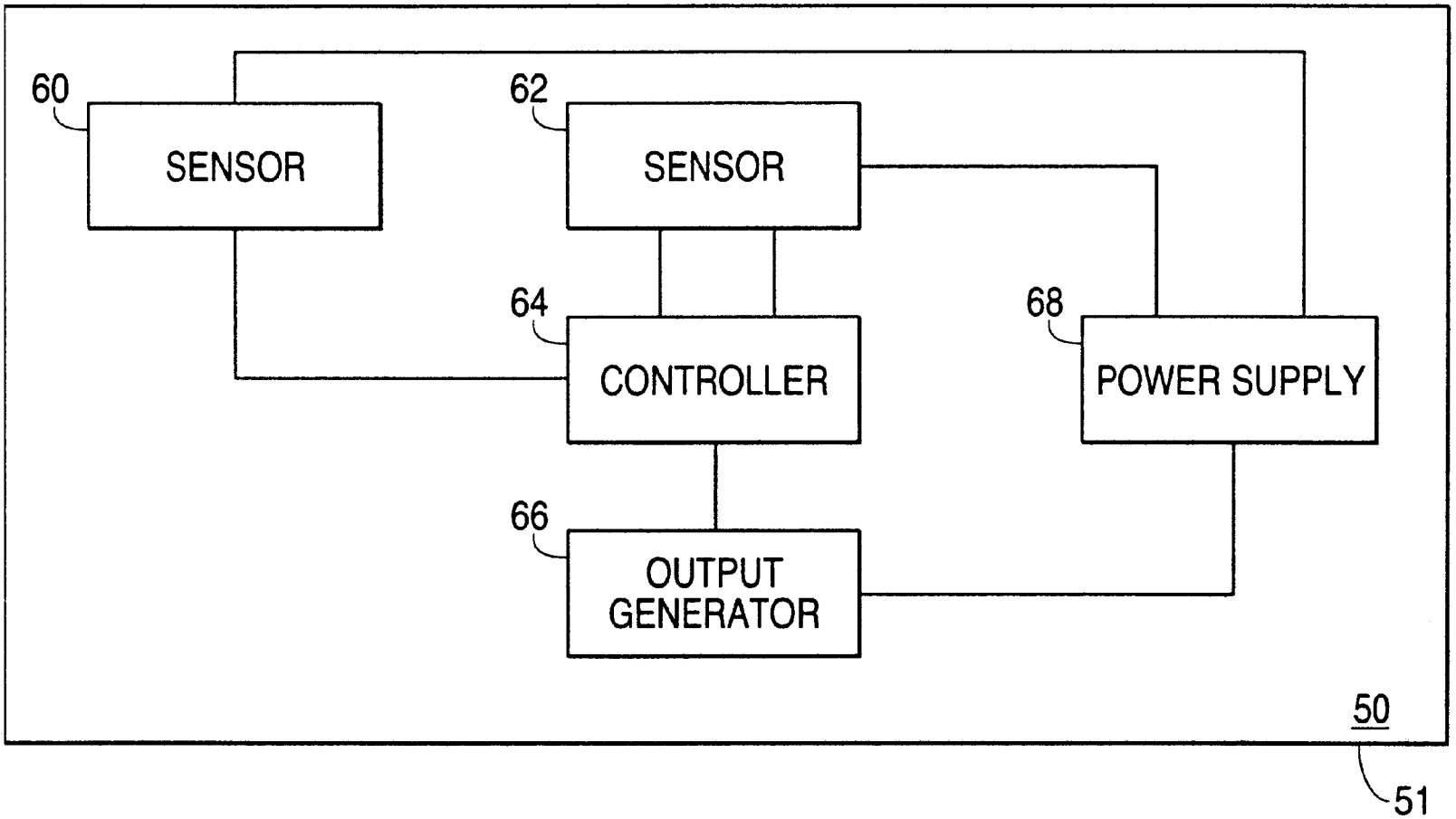
FIG. 6 is a schematic illustration of the electronic unit illustrated in FIG. 4.

As is illustrated in FIGS. 4, 5, 6, and 10, the illustrated embodiment of the potty training device 30 includes an electronic unit 50, which is a unitary and portable structure that is removably couplable to the seat 80 and is configured to house at least some of the electronic components of the potty training device 30. As is illustrated in FIGS. 4 and 5, the electronic unit 50 includes an opening 52, a top end 54, a rear end 56, and a front end 58. The electronic unit 50 includes a housing 51 that is defined by a casing or other structure having an interior that at least partially houses at least some of the electronic components of the potty training device 30. As is illustrated in FIGS. 4–6, in the preferred embodiment, the housing 51 includes multiple housing portions that are attached to one another and that house sensors 60, 62, a controller 64, the sensory output generator 66 and a power supply 68. In an alternative embodiment, the housing 51 only houses a portion of the electronic components of the potty training device 30, such as just the sensor 62, and is defined by one structure molded over or around the portion of the electronic component.

Figure 3:
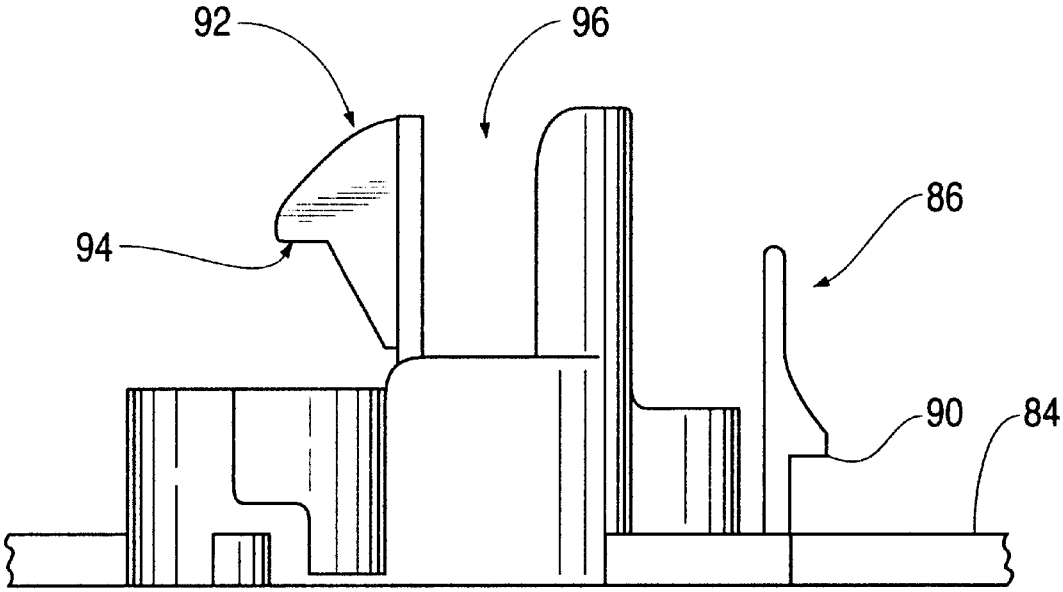
FIG. 3 is a side view a flexible clip and a retaining member of the potty training device illustrated in FIG. 1.
Figure 10:
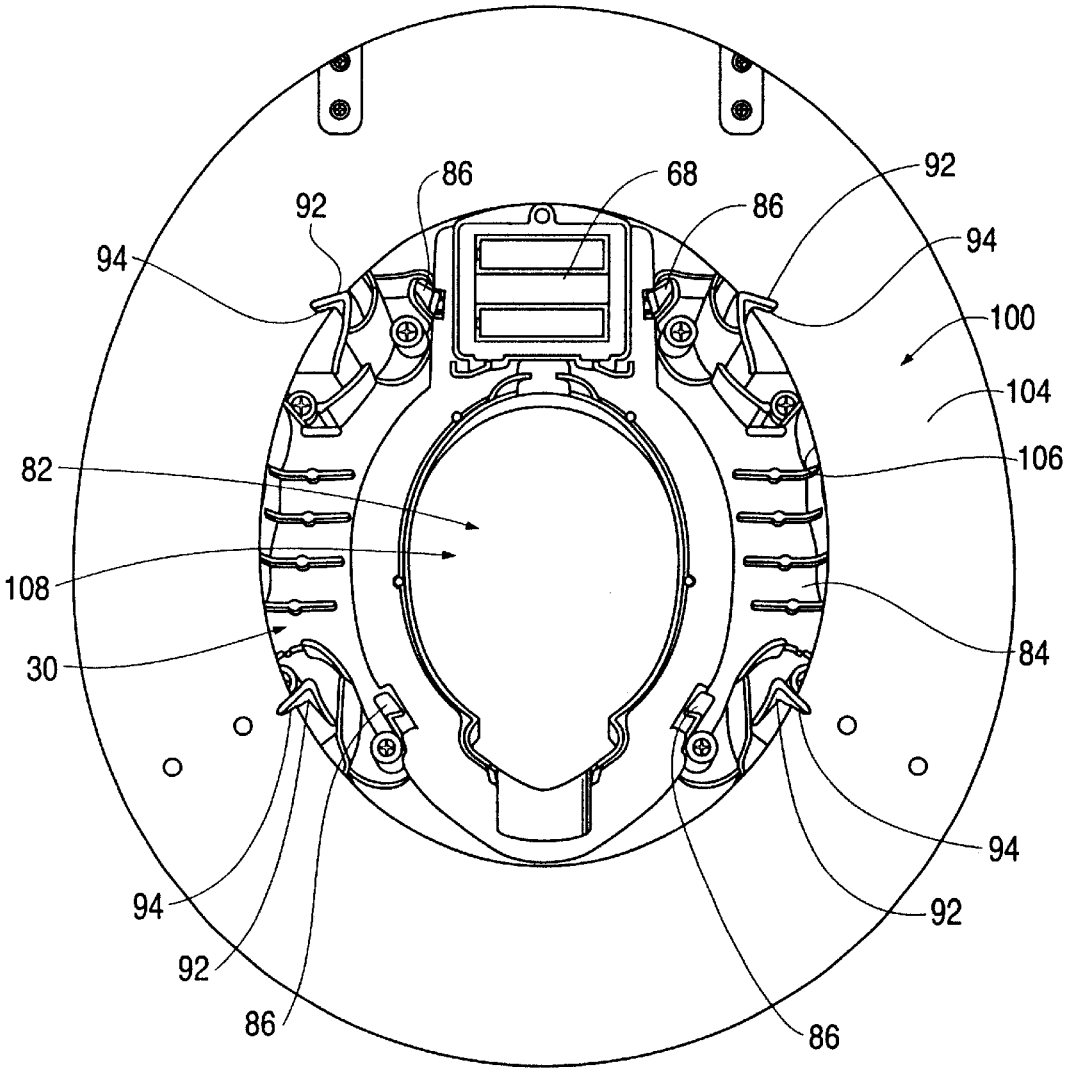
FIG. 10 is a bottom view of the seat/electronic unit combination illustrated in FIG. 5 retained in place with respect to a conventional toilet.

The electronic unit 50 is removably couplable to the seat 80 such that it is readily separable from the seat for cleaning or otherwise. When the electronic unit 50 is coupled to the seat 80, the opening 52 of the electronic unit is aligned with the opening 82 of the seat. Hence, when the electronic unit 50 is coupled to the seat 80 bodily waste passing through the opening 82 of the seat will also pass through the opening 52 of the electronic unit. The electronic unit 50 is removably couplable to the seat 80 via a coupling mechanism, which in the preferred embodiment, is located at the underside 84 of the seat 80 and includes four flexible clips 86. As is best illustrated in FIGS. 3, 5, and 10, each flexible clip 86 includes a ridge 90 that is configured to grasp the electronic unit 50 to removably couple the electronic unit to the seat 80. The flexible clips 86 can be moved away from their biased positions illustrated in FIGS. 5 and 10 to release the electronic unit 50 from the seat 80 for cleaning or, for example, changing of the power supply 68.

Figure 7:
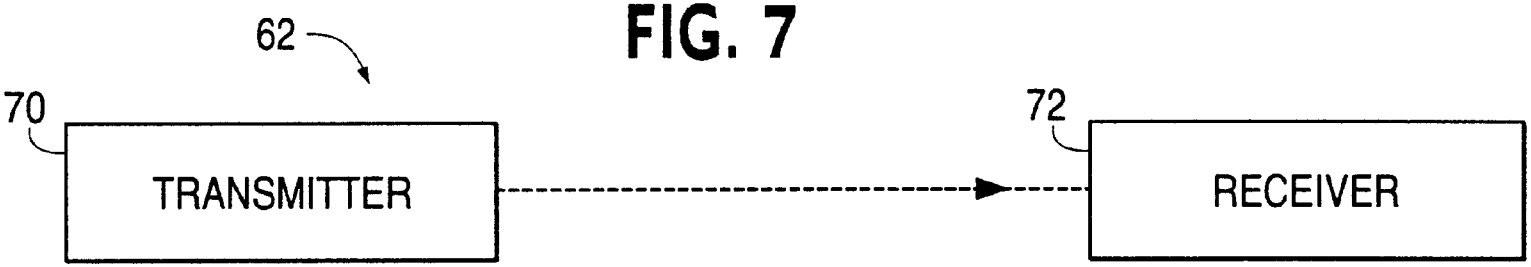
FIG. 7 is a schematic illustration of a sensor of the potty training device illustrated in FIG. 1.

As is illustrated in FIGS. 4–6, the electronic unit 50 houses the sensor 62, which is a device that responds to a signal or stimulus so as to detect or sense when bodily waste is passing through or has passed through the opening 82 of the seat 80. As is illustrated in FIGS. 4 and 7, in the preferred embodiment, the sensor 62 includes a transmitter 70 that transmits energy and a receiver 72 that senses or detects the transmitted energy. The transmitter 70 is preferably a light-generating device, such as one or more light-emitting diodes, lasers, light bulbs or other similar devices, and the receiver 72 is preferably one or more light-sensing components, such as a cadmium sulfide photo-resisters ("CdS cell"). In a particularly preferred embodiment, the transmitter 70 is one light-emitting diode and the receiver 72 includes four CdS cells. As is illustrated in FIG. 4, the one light-emitting diode and four CdS cells of the particularly preferred embodiment generate a 2.54 cm by 10.16 cm (one inch by four inch) sensing area 53 within the opening 52 of the seat electronic unit 50 and that extends from the transmitter 70 to the receiver 72. However, in alternative embodiments, the sensing area 53 can have different dimensions. For example, the sensing area may be 1.27 cm (0.5 inch) wide or may encompass the entire opening 52. In an alternative embodiment of the sensor 62, the transmitter 70 is a heat transducer or a sound transducer and the receiver 72 is a device that detects heat or sound incident from the transducer.

As is illustrated in FIGS. 5 and 10, when the electronic unit 50 is coupled to the seat 80, the transmitter 70 is located such that it emits energy across the opening 82 of the seat 80 in a direction toward the receiver 72. When a user uses the potty training device 30 and passes bodily waste through the opening 82 of the seat 80, the bodily waste will reduce the amount of energy incident on the receiver 72. When the receiver 72 detects a reduction in the amount of energy incident on the receiver, a signal Z is generated by the sensor 62 indicating that the opening 82 of the seat 80 has received bodily waste. The reduction in the amount of energy incident on the receiver 72 can be due to attenuation, absorption, or scattering caused by the bodily waste.

Figure 8:
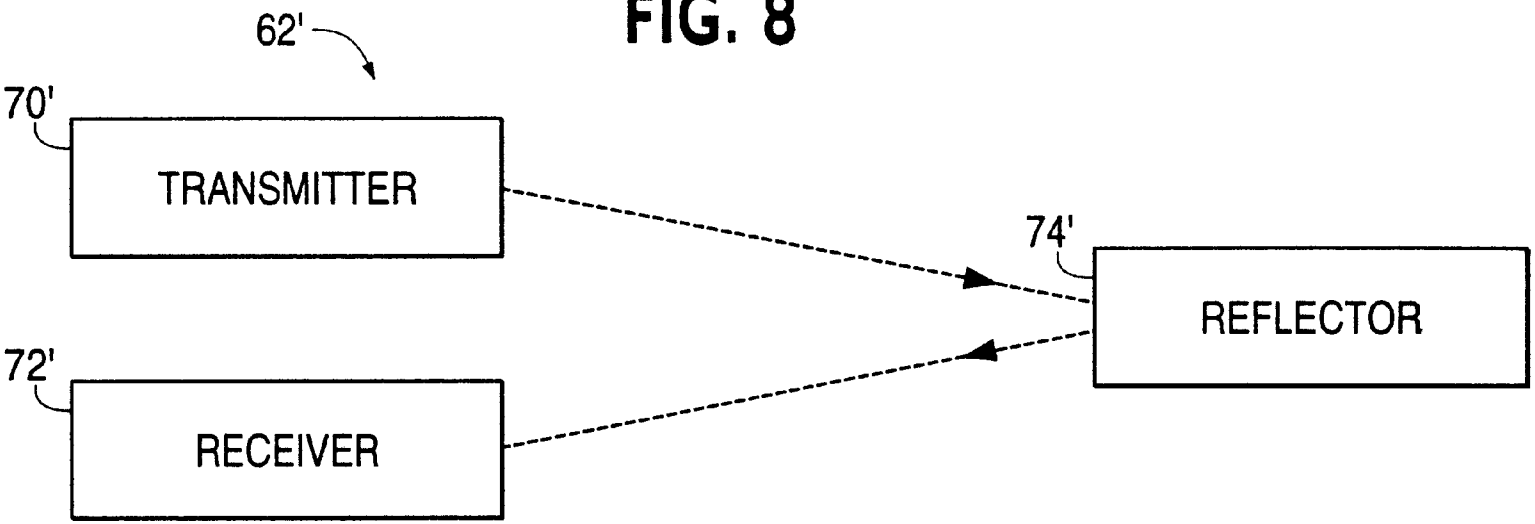
FIG. 8 is a schematic drawing of an alternative embodiment of the sensor of the potty training device illustrated in FIG. 1.

As is illustrated in FIGS. 4, 5, and 10, the transmitter 70 and receiver 72 are located on opposite sides of the opening 52 such that the transmitter 70 transmits energy across the opening in a direction toward the receiver 72. Although the electronic unit 50 defines a continuous loop around the opening 52, in alternative embodiments, the housing 51 only extends partially around the opening 52. For example, in one embodiment, the housing 51 includes an arm that extends only halfway around the opening 52 such that the receiver 72 is opposite from the transmitter 70. In a further embodiment, the transmitter 70 and receiver 72 are not located opposite from one another. For example, as schematically illustrated in FIG. 8, an alternative embodiment of the sensor 62' includes a transmitter 70', a receiver 72', and a reflector 74'. The reflector 74' is one or more devices that reflect energy (i.e. light, sound, heat, vibration, etc.) transmitted by the transmitter 70', such as one or more mirrors, metallic plates, and/or plastic membranes. In the illustrated embodiment, the reflector 74' is a mirror configured to reflect light transmitted by the transmitter 70'. The transmitter 70', receiver 72', and reflector 74' are positioned such that radiation is transmitted by the transmitter across the opening 52, reflected by the reflector, and then received by the receiver after having again crossed the opening 82 of the seat 80. Hence, the transmitter 70' and the receiver 72' can be located adjacent each other, with the reflector 74' located opposite from the transmitter and the receiver. When the receiver 72' detects a reduction in the amount of radiation received from the transmitter 70', a signal Z is generated by the sensor 62' indicating that the opening 82 of the seat 80 has received bodily waste.

In a further embodiment, the sensor 62 includes multiple transmitters 70 that direct energy across the opening 82 to one or more receivers 72. In a further embodiment, the sensor 62 does not include a transmitter 70, but only includes the receiver 72, such as a CdS cell. In this embodiment, the receiver 72 is located and the seat 80 is configured such that ambient light from the environment surrounding the potty training device 30 passes across the opening 82 of the seat prior to being received by the receiver. As above, when the receiver 72 detects or senses a reduction in the amount of light received due to attenuation, absorption, or scattering caused by the bodily waste, a signal Z is generated by the sensor 62 indicating that the opening 82 of the seat 80 has received bodily waste.

In a further embodiment of the potty training device 30, the sensor 62 is a switch that is tripped when in contact with bodily waste. When the switch is tripped by the bodily waste, a signal Z is generated by the switch indicating that the opening 82 of the seat 80 has received bodily waste.

As described above, the electronic unit 50 also houses a sensor 60, which is a device located and configured to detect or sense when a user sits upon the seat 80. In the preferred embodiment the sensor 60 is a motion sensor, such as a ball bearing switch, a mercury switch, or any other motion detection device configured to sense or detect when a user sits upon the seat 80. When the electronic unit 50 is coupled to the seat 80, the sensor 60 detects or senses movement or vibration of the seat 80 and generates a signal X each time motion or vibration is detected. Thus, when a user sits upon the seat 80, the seat moves or vibrates causing the sensor 60 is to generate the signal X indicating that a user has sat upon the seat. In an alternative embodiment, the sensor 60 is a light-sensing component, such as a CdS cell that is housed by the electronic unit 50 proximate the top end 54 such that when the electronic unit is coupled to the seat 80, the sensor 60 is aligned with a window in the seat 80. In this alternative embodiment, the sensor 60 detects or senses changes in the amount of ambient light received and generates the signal X each time the sensor senses a reduction in the amount of received ambient light, such as when a user sits on the seat 80. In further alternative embodiments, the sensor 60 is a heat sensor or a sound sensor located at one or more different locations on the seat 80 and/or the electronic unit 50.

As described above, the electronic unit 50 also houses the sensory output generator 66, which is a device that produces one or more sensory outputs detectable by a user of the potty training device 30, such as an audible output, a visual output, a tactile output, an olfactory output, and/or a gustatory output. In the illustrated embodiment, the sensory output generator 66 is an audio transducer, preferably a speaker, that produces entertaining audible outputs, such as sound effects and musical tunes. In an alternative embodiment, the sensory output generator 66 is or further includes a visual transducer, such as a light display that produces a visual output. In a further embodiment, the sensory output generator 66 is or includes a vibration transducer that produces a tactile output, such as vibrating the seat. In another embodiment, the sensory output generator 66 is or includes an olfactory output generator, such as a scent mechanism that produces an olfactory output, such as a fresh scent. In a further embodiment, the sensory output generator 66 is a gustatory transducer that produces a gustatory output, such as the dispensing of a foodstuff or a sweet liquid.

As is illustrated in FIG. 6, in the illustrated embodiment, the electronic unit 50 further houses the controller 64, which is electrically connected to sensors 60, 62, the sensory output generator 66, and the power supply 68. The controller 64 of the electronic unit 50 is a device that receives the electrical signals Z, X from the sensors 60, 62 and upon receipt of the signals, causes the sensory output generator 66 to produce one or more sensory outputs. When the controller 64 receives the signal X from sensor 60, the controller causes the sensory output generator 66 to produce a first audible output. Additionally, when the controller 64 receives the signal X from sensor 60, the controller causes the sensor 62 to activate such that the transmitter 70 transmits energy and the receiver 72 detects energy. In the preferred embodiment, the sensor 62 will "time-out" after it has been active for five minutes, i.e., the transmitter 70 will cease to transmit energy and the receiver 72 will cease to detect energy. When the controller 64 receives another signal X from the sensor 60, the controller will again cause the sensor 62 to activate. Thus, when the potty training device 30 detects a user seated on the seat 80 a sensory output is generated and the sensor 62 is activated for a period of time such that it can sense or detect bodily waste.

When the controller 64 receives the signal Z from sensor 62, the controller causes the sensory output generator 66 to produce a second audible output that is preferably different from the first audible output. Thus, when bodily waste is detected passing through the opening 82 of the seat 80 a sensory output is generated to reward the user for using the potty training device 30. In the preferred embodiment, the controller 64 is a central processing unit, such as a printed circuit board having a programmed processor and a memory. It will be appreciated that the operations of the controller 64 can be completed by any combination of remotely located and different devices that collectively function as the controller.

In an alternative embodiment, the potty training device 30 does not include the controller 64 or the sensor 60. Rather, the sensor 62 and the sensory output generator 66 are electrically coupled and configured such that the sensory output generator 66 generates a sensory output when the sensor senses the bodily waste.

As is illustrated in FIGS. 4–6, and 10, the electronic unit 50 also houses the power supply 68, which in the preferred embodiment includes batteries. The housing 51 of the electronic unit 50 includes a cover 69, which is removably coupled to the electronic unit 50 to retain the batteries within the electronic unit. In an alternative embodiment, the power supply 68 is external of the housing 51. For example, one or more electrical components of the potty training device 30 may be powered by an AC power source.

Figure 9:
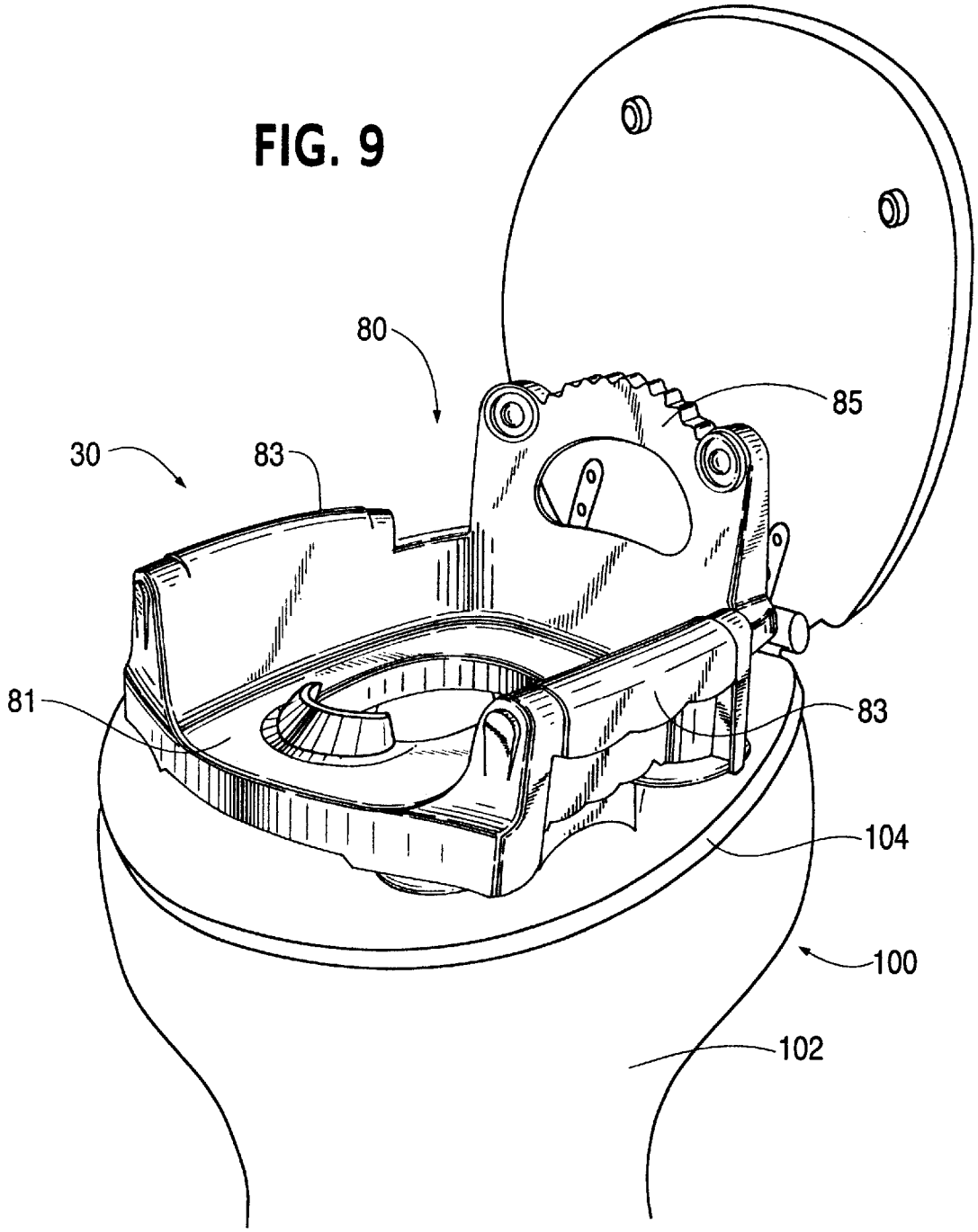
FIG. 9 is a perspective view of the seat/electronic unit combination illustrated in FIG. 5 retained in place with respect to a conventional toilet.

As is illustrated in FIGS. 9 and 10, the seat 80 is configured to be retained in place with respect to a conventional toilet 100, which is a device having a bowl 102, a hinged seat 104, and being configured to flush bodily waste. In the illustrated embodiment, the seat 80 includes four retaining members 92 that are configured and located so as to retain the seat in place with respect to the conventional toilet 100 such that the opening 82 of the seat 80 is located above the bowl 102 of the conventional toilet. The retaining members 92 are flexible, protrude from the underside 84 of the seat 80, and are located on the seat such that they each fit adjacent to a portion of the inner perimeter 106 of the conventional toilet seat 104. As best illustrated in FIG. 3, each retaining member 92 includes a ridge 94 that is configured to engage, such as grasp, clasp, abut, or hold, the underside of the inner perimeter 106 of the conventional toilet seat 104. The retaining members 92 are biased such that the seat 80 is secured to the conventional toilet 100 when it is placed thereon. When the seat 80 is retained above the conventional toilet 100 the opening 82 of the seat 80 is aligned with the opening of the bowl 102 of the conventional toilet. Hence, when a user uses the potty training device 30 with the conventional toilet 100, the bodily waste will pass through the opening 82 into the conventional toilet and the user will be rewarded with a sensory output for this act. In this manner children are encouraged to use the conventional toilet 100 in combination with the potty training device 30, making it easier for parents to potty train their children. To remove the seat from the conventional toilet 100, the retaining members 92 are flexed away from their biased positions, i.e., in a direction away from the inner perimeter 106 of the conventional toilet seat 104. In alternative embodiments of the potty training device 30, the retaining members 92 take other forms. For example, the retaining members 92 may be hinged members, removable members, suction cups, clasps, or other devices that retain the seat 80 in place with respect to the conventional toilet 100. In addition, the retaining members 92 may retain the potty training device 30 in place by engaging the outer perimeter of the seat 104, the outer perimeter of the bowl 102, or the inner perimeter of the bowl.

Figure 11:
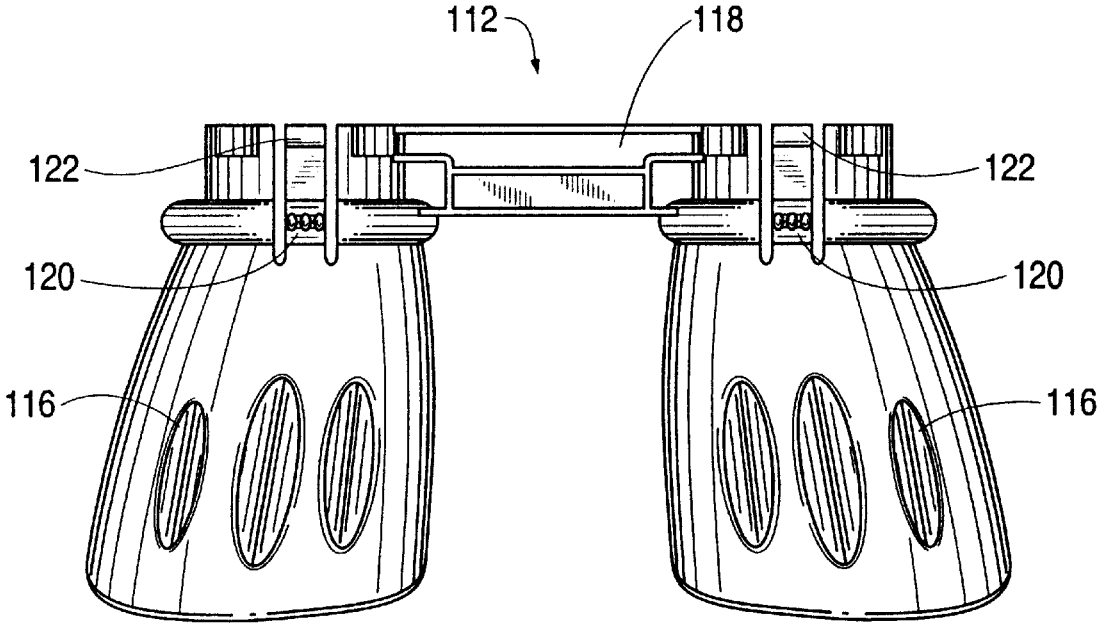
FIG. 11 is a side view of a portion of a support of the potty training device of FIG. 1.
Figure 12:
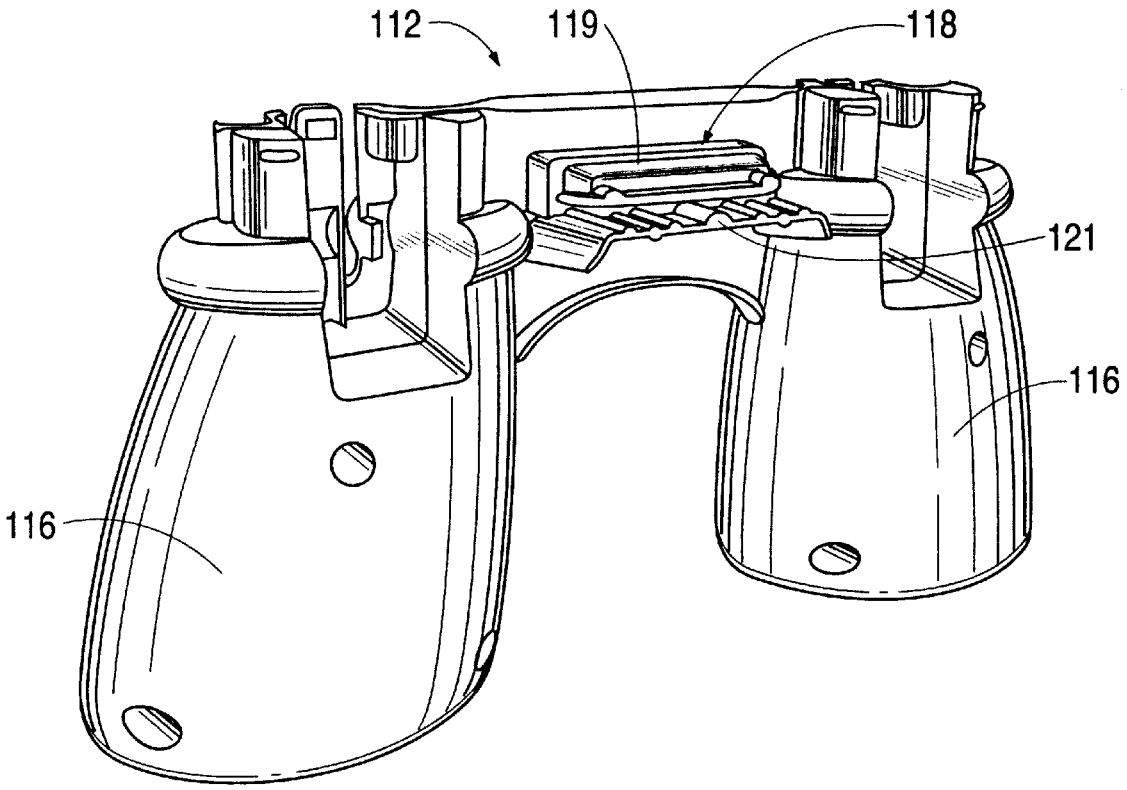
FIG. 12 is a perspective view of a portion of a support of the potty training device of FIG. 1.
Figure 13:
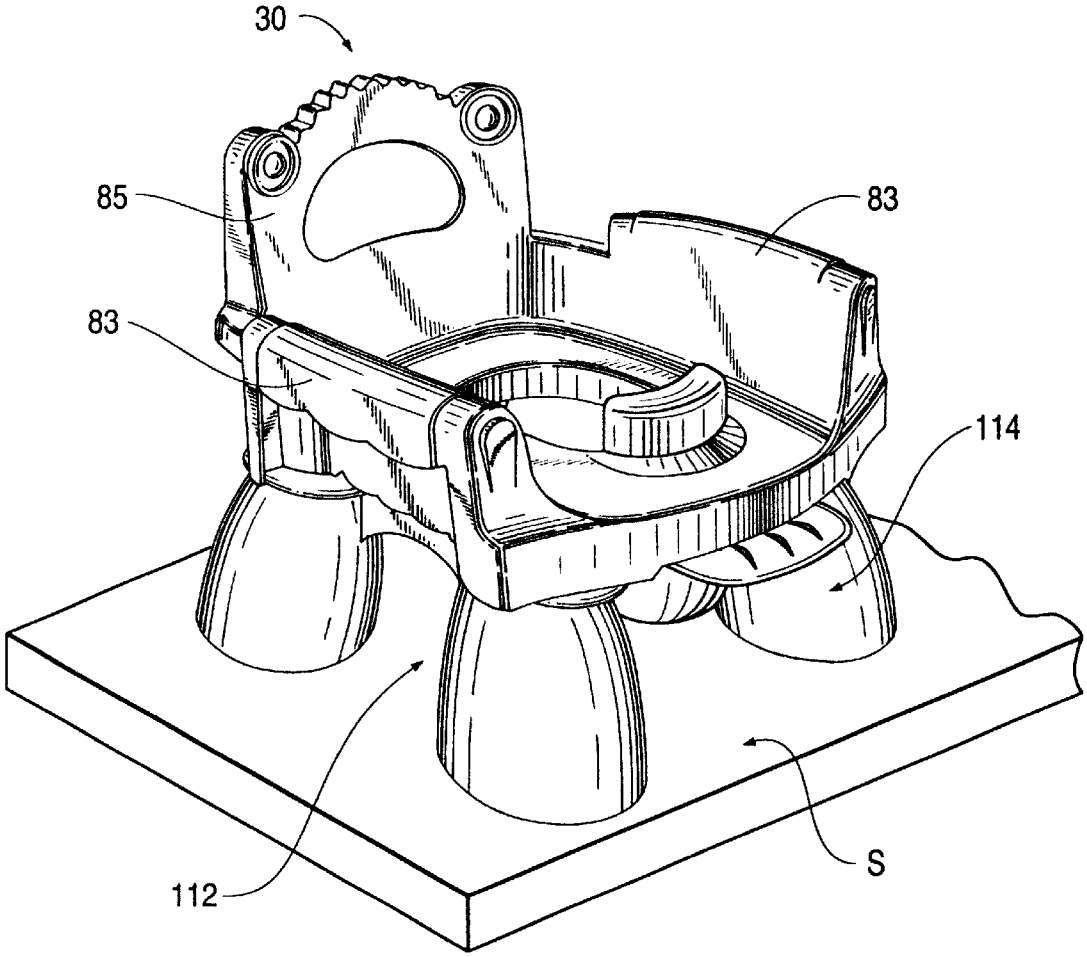
FIG. 13 is a perspective view of the seat/electronic unit combination illustrated in FIG. 4 coupled to the support illustrated in FIGS. 11 and 12.

The potty training device 30 is also configured for use without the conventional toilet 100 such that parents can potty train their children without the conventional toilet. As is illustrated in FIGS. 11–13 and 15, the potty training device 30 includes a support 110 that is configured to support the seat 80 at a position above a support surface S such that a child may sit on the seat and use the potty training device 30. The support 110 is removably couplable to the seat 80 such that the support can be coupled to or removed from the seat 80. As is illustrated in FIGS. 11–13, in the illustrated embodiment, the support 110 includes a right portion 112 and a left portion 114. The right portion 112 and the left portion 114 each include two legs 116 and a side bar 118 located between each leg. The right and left portions 112, 114 each include at least one flexible member 120 with a ridge 122. The right and left portions 112, 114 are insertable into leg receiving areas 96 of the seat 80 at the underside 84 of the seat (see FIGS. 2 and 3). The flexible members 120 are biased such that when the right and left portions 112, 114 of the support 110 are inserted into the leg receiving areas 96, the ridges 122 engage with openings 98 to secure the right and left portions to the seat 80. The flexible members 120 can be moved from their biased positions to disengage the ridges 122 from the openings 98, thereby releasing the right and left portions 112, 114 of the support 110 from the seat 80.

In alternative embodiments, the support 110 is a unitary structure, a platform, a plurality of legs, or any other type of structure that is configured to support the seat 80 above the support surface S such that a child or other user may sit on the seat and use the potty training device 30.

Figure 14:
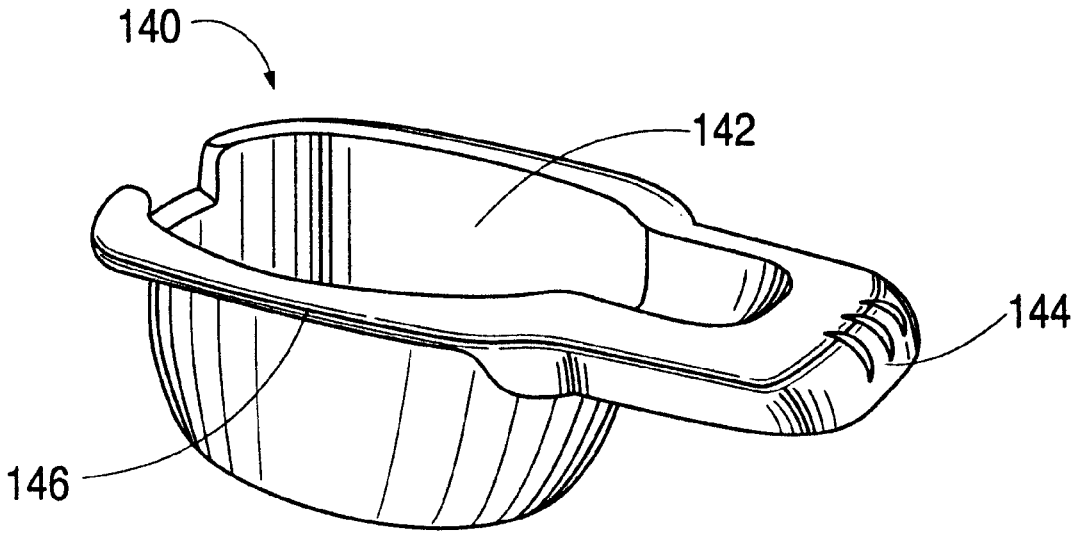
FIG. 14 is a perspective view of a receptacle of the potty training device illustrated in FIG. 1.
Figure 15:
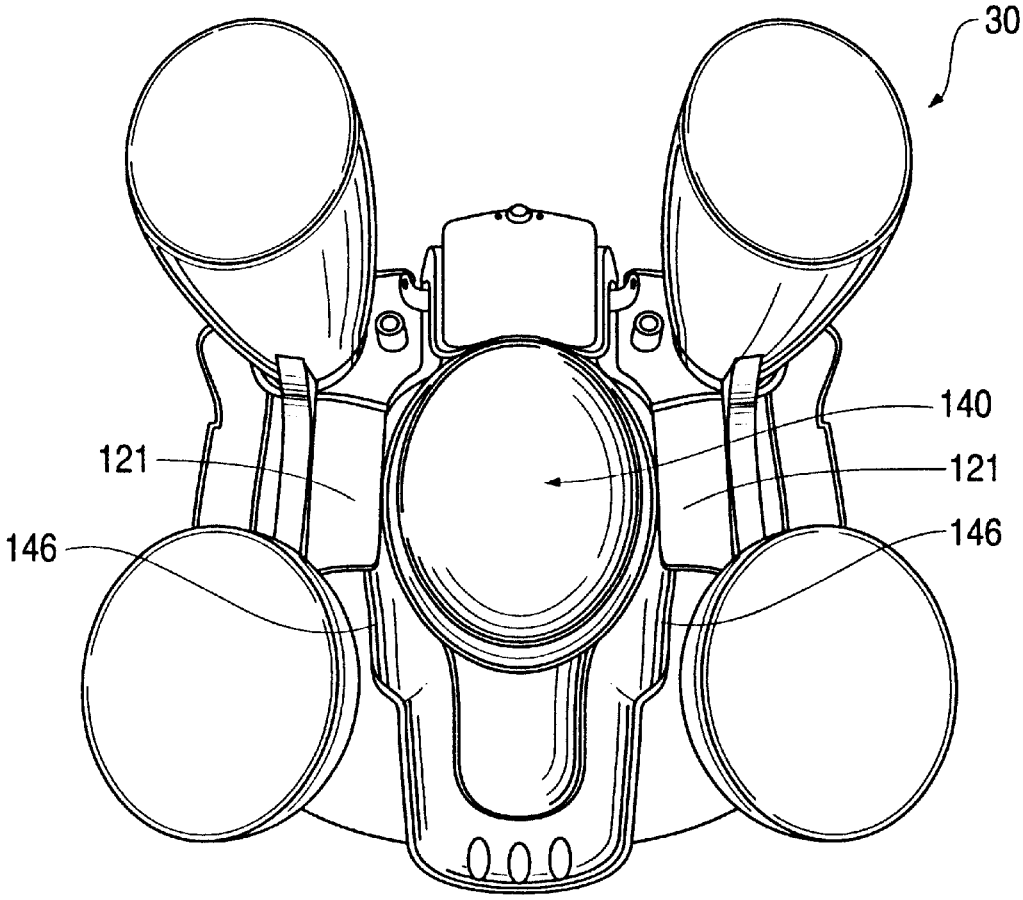
FIG. 15 is a bottom view of the potty training device illustrated in FIG. 1, where the seat/electronic unit combination illustrated in FIG. 5 is coupled to the support illustrated in FIG. 13 and to the receptacle illustrated in FIG. 14.

As is illustrated in FIGS. 14 and 15, the potty training device 30 also includes a receptacle 140, which is configured to receive bodily waste that has passed through the opening 82 of the seat 80 when the seat is not being used with the conventional toilet 100, i.e., when the seat is supported above the support surface S by the support 110. The receptacle 140 includes a bowl 142, a handle 144, and a pair of flanges 146. When the support 110 is coupled to the seat 80 the receptacle 140 may be removably supported adjacent to the opening 82 of the seat 80 such that the bowl 142 is aligned below the opening of the seat. As best illustrated in FIGS. 11, 12, and 15, the inner side 119 of each side bar 118 includes a ledge 121 that is configured to support the receptacle 140 above the support surface S and adjacent to the opening 82 of the seat 80. The flanges 146 of the receptacle 140 rest upon the ledges 121 when the support 110 is coupled to the seat. Hence, when the support 110 is coupled to the seat 80, the receptacle 140 may be inserted above and between the opposing ledges 121 such that the flanges 146 rest upon the ledges 121 and the bowl 142 is located below the opening 82 of the seat. In this manner, the receptacle 140 is located to receive bodily waste that passes through the opening 82. The receptacle 140 can be removed from the seat 80 by grasping the handle 144 and sliding the receptacle away from the seat. In this manner, a parent may remove the receptacle 140 after use of the potty training device 30 so as to dispose of the bodily waste and clean the receptacle. In alternative embodiments of the potty training device 30, the receptacle 140 is removably supported under the opening 82 of the seat 80 in other manners. For example, in an alternative embodiment, the receptacle 140 and/or the seat 80 include flexible members similar to those described above that removably couple the receptacle and the seat.

The potty training device 30 is thus configured for use with and without a conventional toilet 100, which is advantageous because some children are apprehensive to use conventional toilets. Parents may selectively choose to potty train their children with the potty training device 30 in a first mode where the seat 80 is supported above the support surface S and in a second mode where the potty training device is retained in place with respect to the conventional toilet 100.

Alternative embodiments of potty training devices 30*a*, 30*a*', and 30*b* in accordance with the present invention are illustrated in FIGS. 16–23. As will be realized, portions of the foregoing discussion of the benefits and functions of the potty training device 30 also apply to the potty training devices 30*a*, 30*a*', and 30*b*. Thus, the potty training devices 30*a*, 30*a*', and 30*b* illustrated in FIGS. 16–23 have been assigned corresponding reference numbers as the potty training device, with a reference letter ("a" or "b") or prime ("'"). The potty training devices 30*a*, 30*a*', and 30*b* illustrated in FIGS. 16–23 also include additional features and inherent functions, as described in detail below.

Figure 16:
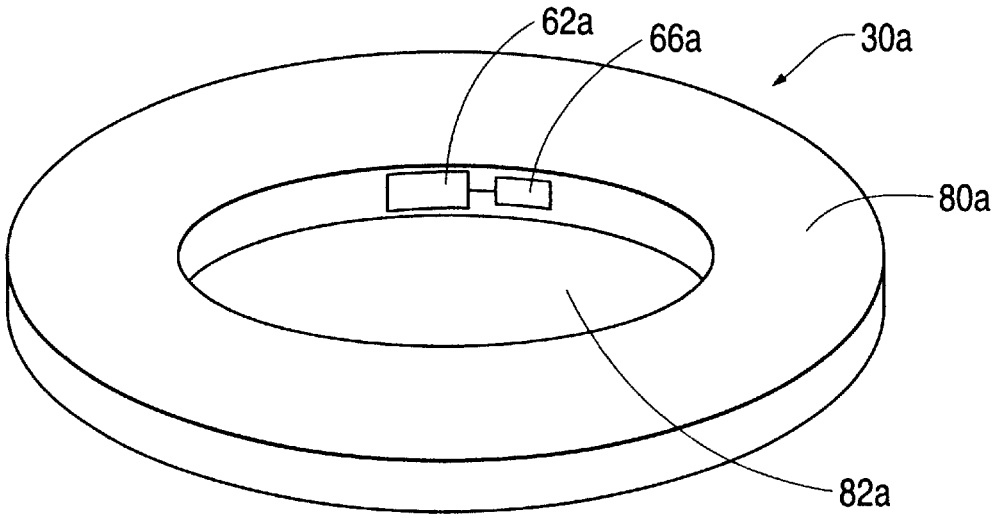
FIG. 16 is a top perspective view of a potty training device in accordance with an alternative embodiment of the present invention.
Figure 17:
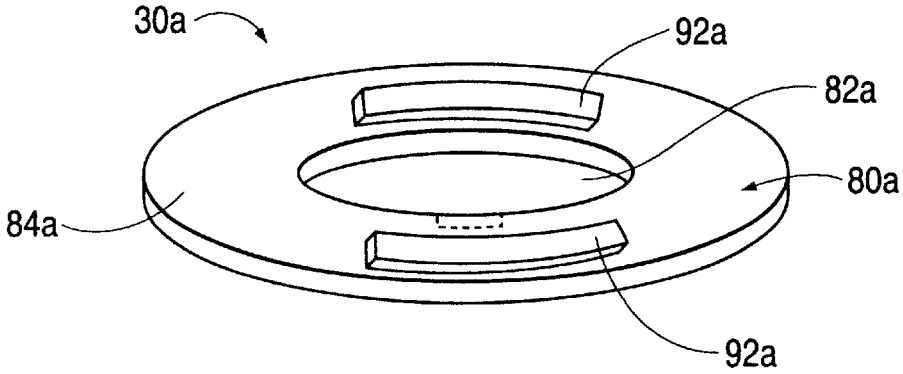
FIG. 17 is a bottom perspective view of the potty training device illustrated in FIG. 16.
Figure 18:
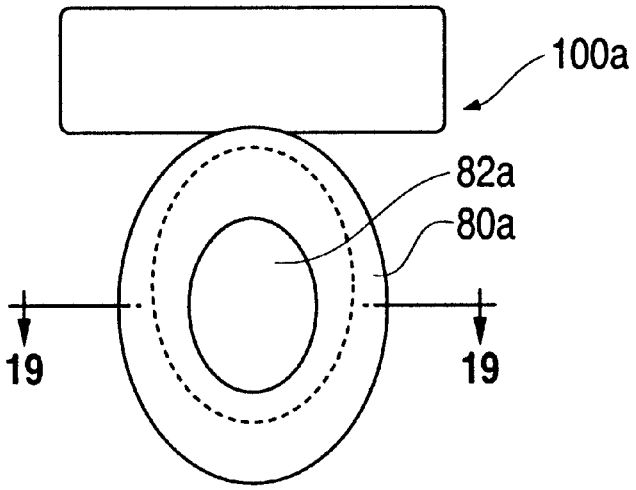
FIG. 18 is a top view of the potty training device illustrated in FIG. 16 retained in place with respect to a conventional toilet.

As is illustrated in FIGS. 16–19, the potty training device 30*a* includes a seat 80*a* having an opening 82*a* and retaining members 92*a* that retain the seat in place with respect to the conventional toilet 100*a* such that the opening 82*a* of the seat 80*a* is located above the bowl 102*a* of the conventional toilet. As is illustrated in FIG. 16, the potty training device 30*a* includes a sensor 62*a* that detects bodily waste as it passes through the opening 82*a* of the seat 80*a* and a sensory output generator 66*a* that generates a sensory output when the sensor senses the bodily waste. Unlike the sensor 62 and the sensory output generator 66 of the potty training device 30, the sensor 62*a* and the sensory output generator 66*a* are not part of an electronic unit that is removably couplable to the seat 80*a*. Rather, the sensor 62*a* and the sensory output generator 66*a* are integral with the seat 80*a*. For example, the body of the seat 80 is molded over the sensor 62*a* and the sensory output generator 66*a*. The sensor 62*a* and the sensory output generator 66*a* may be powered by an AC or a DC power source.

Figure 19:
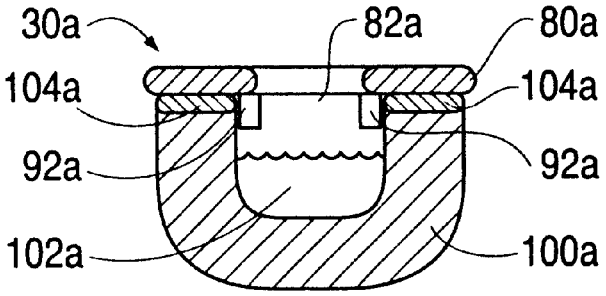
FIG. 19 is a cross-sectional view of the potty training device illustrated in FIG. 16 taken along the line 19—19 in FIG. 18.

The retaining members 92*a* are arcute protrusions that protrude from the underside 84*a* of the seat 80*a*. The retaining members 92*a* abut against or rest upon the conventional toilet 100 to retain the seat 80*a* in place with respect to the conventional toilet. As is illustrated in FIG. 19, the retaining members 92*a* are located on the underside 84*a* of the seat 80*a* such that when the seat is placed on the conventional toilet 100*a* the retaining members fit within the opening of the seat 104*a* of the conventional toilet to retain the seat in place with respect to the conventional toilet such that it does not slide off of the conventional toilet. Because the potty training device 30*a* is configured for use with the conventional toilet 100*a*, like the potty training device 30, parents can use the potty training device to accustom a child to using the conventional toilet.

Figure 20:
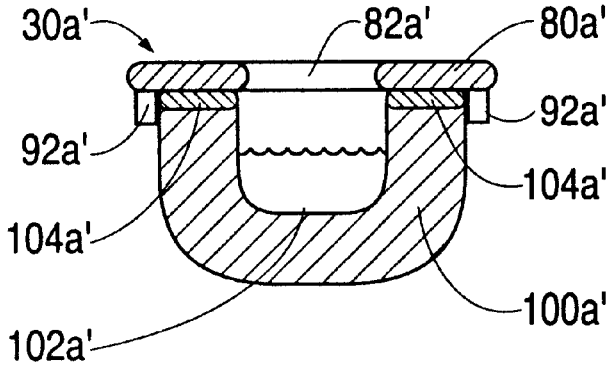
FIG. 20 is a cross-sectional view of a potty training device in accordance with an alternative embodiment of the present invention, where the potty training device is retained in place with respect to a conventional toilet.

An alternative embodiment of the potty training device 30*a*' is illustrated in FIG. 20. The potty training device 30*a*' includes a seat 80*a*' having an opening 82*a*' and two retaining members 92*a*' that are located to fit around the outside perimeter of the seat 104*a*' of a conventional toilet 100*a*' so as to retain the seat 80*a*' in place with respect to the conventional toilet.

In alternative embodiments, the retaining members 92*a* are located to fit within the bowl 102 of the conventional toilet 100 or are located to fit around the outside perimeter of the bowl of the toilet so as to retain the seat 80*a* in place with respect to the conventional toilet.

In a further embodiment or the potty training device 30*a*, the retaining members 92*a* include multiple protrusions, one of which is located to fit within the opening of the seat 104*a* while another is located to fit around the outside perimeter of the seat 104*a* so as to retain the seat 80*a* of the potty training device 30*a* in place with respect to the conventional toilet 100. In a further embodiment, the retaining members 92*a* include multiple protrusions, one of which is located to fit within the bowl 102*a* of the conventional toilet 100*a* while another is located to fit around the outside perimeter of the bowl of the conventional toilet so as to retain the seat 80*a* in place with respect to the conventional toilet. In a further embodiment, the retaining members 92*a* are defined by one or more recesses or cavities in the seat 80*a*.

In a further embodiment of the potty training device 30*a*, the retaining member 92*a* is one continuous protrusion that protrudes from the underside 84*a* of the seat 80*a* so as to retain the seat 80*a* in place with respect to the conventional toilet.

Figure 21:
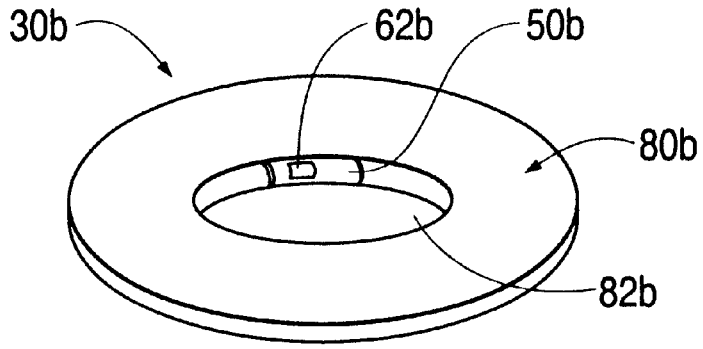
FIG. 21 is a top perspective view of a seat of a further embodiment of a potty training device in accordance with the present invention.
Figure 22:
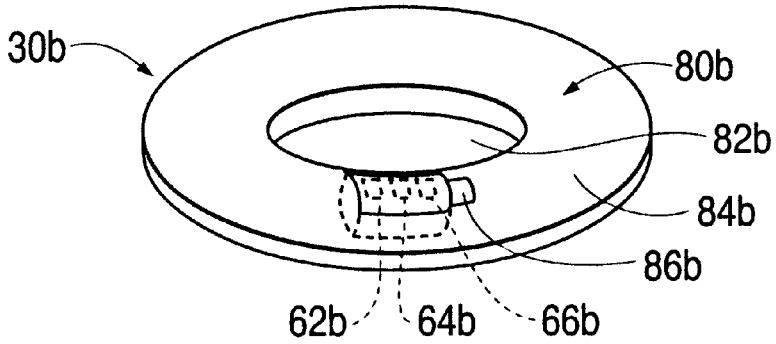
FIG. 22 is a bottom perspective view of the potty training device illustrated in FIG. 21.
Figure 23:
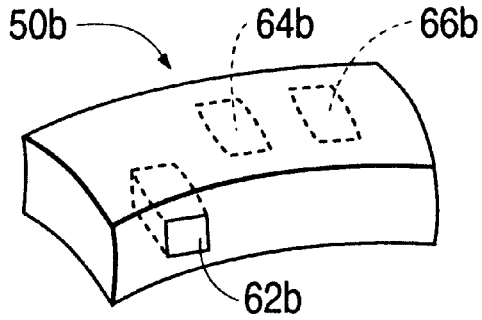
FIG. 23 is a perspective view of an electronic unit of the potty training device illustrated in FIG. 21.

Another embodiment of the potty training device 30*b* in accordance with the present invention is illustrated in FIGS. 21–23. The potty training device 30*b* includes a seat 80*b* having an opening 82*b* and further including an electronic unit 50*b* that houses at least a sensor 62*b*, which detects or senses bodily waste as it passes through the opening 82*b* of the seat 80*b*. In the illustrated embodiment, the electronic unit 50*b* also houses a controller 64*b* and a sensory output generator 66*b*. Each time the sensor 62*b* senses bodily waste a sensory output is generated by the sensory output generator 66*b*.

The electronic unit 50*b* and/or the seat 80*b* includes a coupling mechanism 86*b* that removably couples the electronic unit to the seat 80*b*. Thus, the electronic unit 50*b* can be coupled to, or removed from, the seat 80*b*. The coupling mechanism 86*b* is a hook, a clasp, a clip, a snap, a button, or any other device that removably couples the electronic unit 50*b* to the seat 80*b*. Because the electronic unit 50*b* is removably coupled to the potty training device 30*b*, a parent can easily remove the electronic unit from the potty training device 30*b* to clean the device. As will be appreciated, the potty training device 30*b* may be configured for use with a conventional toilet and/or such that it is supported above a support surface for independent use.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A potty training device comprising:

a seat having an opening for receiving bodily waste, said seat including a retaining member configured and located so as to retain said seat in place with respect to a toilet such that said opening of said seat is located above a bowl of the toilet;

a sensor for sensing bodily waste, said sensor configured to be coupled to said seat and located so as to sense bodily waste that passes through said opening of said seat; and a sensory output generator for generating a sensory output in response to said sensor sensing bodily waste.

2. The potty training device of claim 1, further comprising:

a controller configured to receive a signal from said sensor and cause said sensory output to be generated by said sensory output generator.

3. The potty training device of claim 1, said sensor including a receiver that senses energy.

4. The potty training device of claim 3, said sensor further including a transmitter configured to transmit energy to said receiver.

5. The potty training device of claim 4, said transmitter being located so as to transmit energy across said opening to said receiver.

6. The potty training device of claim 4, further comprising:

a reflector located so as to receive radiation from said transmitter and reflect the energy toward said receiver.

7. The potty training device of claim 4, said receiver being configured to sense light, said transmitter being configured to transmit light.

8. The potty training device of claim 1, said sensor including at least one of an optical receiver, a heat receiver, a sound receiver, and a vibration receiver.

9. The potty training device of claim 8, said sensor including said sound receiver and a sound generator located to transmit sound toward said sound receiver.

10. The potty training device of claim 1, said sensor being an electronic sensor, further comprising:

a housing separate from said seat and configured to be coupled to said seat, said sensor being housed in said housing.

11. The potty training device of claim 10, further comprising a power source, said power source being located within said housing.

12. The potty training device of claim 10, at least one of said housing and said seat having a mechanism configured to removably attach said housing to said seat.

13. The potty training device of claim 12, said mechanism including flexible clips.

14. The potty training device of claim 1, said sensory output generator being at least one selected from the group consisting of:

an audible transducer, a visual transducer, a tactile transducer, a olfactory transducer, and a gustatory transducer.

15. The potty training device of claim 14, said sensory output generator including at least said audible transducer.

16. The potty training device of claim 1, further comprising:

a support configured to support said seat at an elevated location with respect to a support surface.

17. The potty training device of claim 16, further comprising:

a receptacle for receiving bodily waste that passes through said opening.

18. The potty training device of claim 16, said support including a plurality of legs that are removably coupleable to said seat.

19. The potty training device of claim 1, said retaining member being located at least one of a first location on said seat and a second location on said seat, said retaining member fitting adjacent to at least a portion of an outer perimeter of a seat of the toilet or an outer perimeter of a bowl of the toilet when said retaining member is located at said first location, said retaining member fitting adjacent to at least a portion of an inner perimeter of the seat of the toilet or an inner perimeter of the bowl when said retaining member is located at said second location.

20. The potty training device of claim 19, said retaining member protruding from an underside of said seat that faces the toilet when said seat is retained in place with respect to the toilet.

21. The potty training device of claim 19, said retaining member being arcuate.

22. The potty training device of claim 19, said retaining member being one of a plurality of retaining members.

23. The potty training device of claim 19, said retaining member including at lease one circumferential lip.

24. The potty training device of claim 19, said retaining member including at least one flexible member having a ridge configured to clasp onto an edge of the seat of the toilet or an edge of the bowl of the toilet.

25. The potty training device of claim 1, said sensor being a first sensor, further comprising a second sensor for sensing when a user sits on said seat.

26. The potty training device of claim 25, further comprising a controller configured to supply power to said first sensor in response to said second sensor sensing when a user sits on said seat.

27. The potty training device of claim 25, said second sensor including a motion sensor.

28. The potty training device of claim 26, said sensory output being a first sensory output, said controller being configured to cause said sensory output generator to generate a second sensory output in response to said second sensor sensing when the user sits on said seat, said first sensory output being different than said second sensory output.

29. A potty training device comprising:

a seat having an opening for receiving bodily waste;

an electronic unit having a housing that at least partially contains a sensor for sensing the bodily waste, a power source, and a sensory output generator for outputting a sensory output when said sensor senses the bodily waste, at least one of said electronic unit and said seat including a mechanism configured and located to removably couple said electronic unit and said seat, said sensor being located so as to sense bodily waste received by said opening when said electronic unit and said seat are removably coupled; and at least one leg being removably coupled to said seat.

30. The potty training device of claim 29, said sensor including a receiver that senses energy.

31. The potty training device of claim 30, said sensor further including a transmitter configured to transmit energy to said receiver.

32. The potty training device of claim 31, said transmitter being located so as to transmit energy across said opening to said receiver.

33. The potty training device of claim 31, said receiver being configured to sense light, said transmitter being configured to transmit light.

34. The potty training device of claim 29, said sensor including at least one of an optical receiver, a heat receiver, a sound receiver, and a vibration receiver.

35. The potty training device of claim 29, said sensory output generator including an audible transducer.

36. The potty training device of claim 29, further comprising:

a support configured to support said seat at an elevated location with respect to a support surface.

37. The potty training device of claim 29, further comprising:

a receptacle for receiving bodily waste that passes though said opening.

38. The potty training device of claim 29, said sensor being a first sensor, further comprising a second sensor for sensing when a user sits on said seat.

39. The potty training device of claim 38, said sensory output being a first sensory output, further comprising a controller configured to cause said sensory output generator to generate a second sensory output in response to said second sensor sensing when the user sits on said seat, said first sensory output being different than said second sensory output.

40. The potty training device of claim 29, said mechanism including a least one clip, at least one of said housing and said seat including said at least one clip.

41. The potty training device of claim 40, said at least one clip being one of a plurality of clips.

42. A potty training device comprising:

a seat having an opening for receiving bodily waste;

at least one leg removably coupled to said seat;

means for sensing bodily waste;

a power source;

means for outputting a sensory output when said sensing means senses bodily waste;

means for housing said sensing means, said power source, and said outputting means; and means for removably coupling said housing means and said seat such that said sensing means is located so as to sense bodily waste that passes through said opening.

43. The potty training device of claim 42, further comprising:

means for retaining said seat in place with respect to a toilet such that said opening of said seat is located above a bowl of the toilet.

44. A potty training device comprising:

a seat having an opening for receiving bodily waste, said seat including means for retaining said seat in place with respect to a toilet such that said opening of said seat is located above a bowl of the toilet;

means for sensing bodily waste that passes through said opening;

means for generating a sensory output in response to said means for sensing bodily waste; and means for removably coupling said means for sensing bodily waste to said seat.

45. The potty training device of claim 44, further comprising:

a support configured to support said seat at an elevated location with respect to a support surface.

46. The potty training device of claim 45, said support including a plurality of support legs that are removably coupleable to said seat.

47. The potty training device of claim 44, further comprising means for housing said sensing means and said generating means.

48. The potty training device of claim 47, further comprising means for removably attaching said housing means to said seat.

49. The potty training device of claim 44, further comprising:

means for sensing when a user sits on said seat.

50. A method comprising:

retaining a seat in place with respect to a toilet such that a sensor of the seat is located so as to sense bodily waste that passes through an opening of the seat and into the toilet; and coupling an electronic unit having a housing that houses a power source, a sensory output generator, and an electric sensor for sensing bodily waste to a seat such that the sensor is located so as to sense bodily waste that passes through an opening of the seat.

51. A potty training device comprising:

a chair having a seat, an opening for receiving bodily waste, and an area for removably receiving a housing;

a support configured to support said seat at an elevated location with respect to a support surface, said support being removably coupled to said seat;

an electronic sensor for sensing bodily waste; and a sensory output generator for generating a sensory output in response to said electronic sensor sensing bodily waste, said electronic sensor and said sensory output generator being at least partially housed by said housing such that when said housing is received by said area said electronic sensor is located so as to sense bodily waste as the bodily waste passes through said opening.

52. An apparatus comprising:

a potty training device configured for operation in a first mode and in a second mode, the potty training device have a sensor for sensing bodily waste and a sensory output generator for generating a sensory output in response to said sensor sensing bodily waste, said potty training device having a seat retained in place with respect to a conventional toilet such that bodily waste that passes through an opening of said seat enters a bowl of the conventional toilet when said potty training device is operating in said first mode, said seat being supported above a support surface by a support such that bodily waste that passes through said opening of said seat enters a bowl of a receptacle of the potty training device when said potty training device is operating in said second mode.

53. The apparatus of claim 52, further comprising:

a controller configured to receive a signal from said sensor and cause said sensory output to be generated by said sensory output generator.

54. The apparatus of claim 52, said sensor including a receiver that senses energy.

55. The apparatus of claim 52, said sensory output generator being at least one selected from the group consisting of:

an audible transducer, a visual transducer, a tactile transducer, a olfactory transducer, and a gustatory transducer.

56. A potty training device comprising:

a seat having an opening for receiving bodily waste, said seat including a retaining member configured and located so as to retain said seat in place with respect to a toilet such that said opening of said seat is located above a bowl of the toilet;

a first sensor for sensing bodily waste, said sensor being located so as to sense bodily waste that passes through said opening of said seat;

a second sensor for sensing when a user sits on said seat; and a sensory output generator for generating a sensory output in response to said sensor sensing bodily waste.

* * * * *